United States Patent [19]

Kato et al.

[11] 3,946,884

[45] Mar. 30, 1976

[54] METHOD FOR TRANSPORTING TEXTILE YARN PACKAGES

[75] Inventors: Takashi Kato, Kariya; Toshio Yoshizawa, Chiryu; Yoshihisa Suzuki, Nagoya; Shozo Ueda, Kariya, all of Japan

[73] Assignees: Kabushiki Kaisha Toyoda Jidoshokki Seisakusho, Aichi; Daiwa Boseki Kabushiki Kaisha, Osaka, both of Japan

[22] Filed: Jan. 23, 1974

[21] Appl. No.: 435,948

[30] Foreign Application Priority Data

| | | |
|---|---|---|
| Jan. 23, 1973 | Japan | 44-9662 |
| May 17, 1973 | Japan | 45-55027 |
| June 26, 1973 | Japan | 45-72066 |

[52] U.S. Cl. ..... 214/152; 53/159; 198/103; 198/131; 214/DIG. 3; 214/8; 214/41 R; 280/47.35

[51] Int. Cl.[2] ..... B65G 57/26

[58] Field of Search..... 214/8 R, 41, 152, DIG. 1, 214/DIG. 3; 242/35.5 A, 79; 53/142, 159, 204; 198/131

[56] References Cited

UNITED STATES PATENTS

| | | | |
|---|---|---|---|
| 2,913,098 | 11/1959 | Zellinsky et al. | 198/131 X |
| 3,024,887 | 3/1962 | Ingham | 198/131 X |

FOREIGN PATENTS OR APPLICATIONS

| | | | |
|---|---|---|---|
| 938,276 | 10/1963 | United Kingdom | 242/35.5 A |

OTHER PUBLICATIONS

Component Orienting Apparatus, IBM Technical Disclosure Bulletin, Vol. 15, No. 1, June 72.

*Primary Examiner*—Robert G. Sheridan

[57] ABSTRACT

An automatic method and apparatus is furnished for transporting yarn packages formed on the cylindrical tubes by a conveyer belt disposed adjacently along a textile machine or a group of textile machines and for transferring the yarn packages from the conveyer belt to receiving rods of a transporting means. In the apparatus, an auxiliary device for correctly transferring the yarn packages from the conveyer belt to the transporting means is satisfactorily utilized.

8 Claims, 31 Drawing Figures

Fig. 1
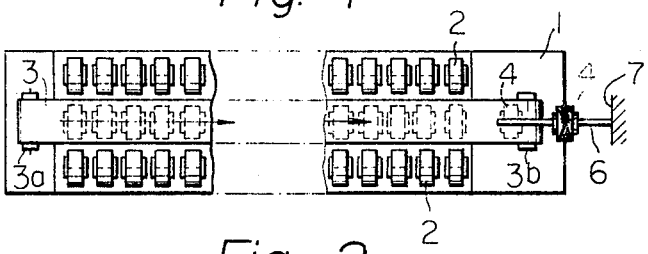
Fig. 2
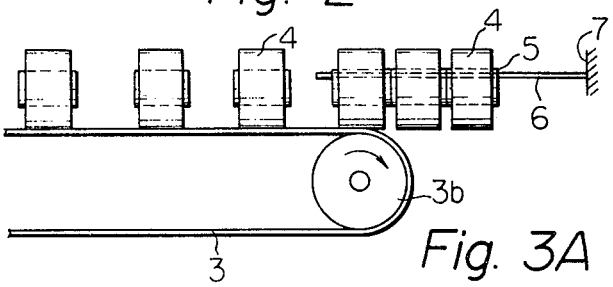
Fig. 3A
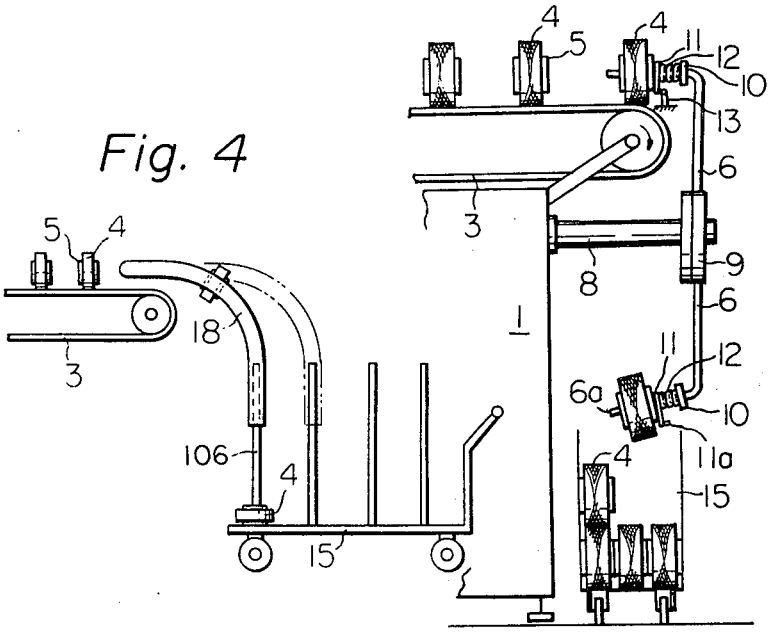
Fig. 4

METHOD FOR TRANSPORTING TEXTILE YARN PACKAGES

SUMMARY OF THE INVENTION

The present invention relates to an automatic method and apparatus for transporting yarn packages wound on a cylindrical tube, from a processing area where the yarn packages are produced by textile machines to a subsequent process without touching any yarn layer thereof.

In an open-end spinning process, it is advantageous if the yarn packages produced by the process are doffed onto a conveyer disposed in close proximity to an open-end spinning frame or a group of open-end spinning frames so as to be carried toward a terminal of the conveyor belt and then transferred to a transportation carrier or a subsequent conveyer. As the yarn package is formed on a cylindrical tube, it is desirable that the yarn layers of the yarn packages not be touched during movement of the packages so as to prevent damage to the yarn package.

The present invention is particularly useful for automatically transporting yarn packages, produced by open-end spinning machines, by a conveyor belt disposed in close proximity to the open-end spinning machine or a group of open-end spinning machines, and then transferring the packages to a transportation carrier or a transportation conveyer. In other words, the principal object of the present invention is to provide a unique method and apparatus for transporting yarn packages wound on a cylindrical tube from a processing area where the yarn packages are produced to a subsequent processing area without touching or gripping any yarn layer thereof so as to prevent damage to the yarn package.

To attain the above-mentioned purpose, in the present invention, the yarn packages are handled by a receiving rod or like member in such a manner that the receiving rod is inserted into the cylindrical tube of one or more of the yarn packages when the yarn packages are transferred from the conveyer belt, which carries the yarn packages doffed from the textile machines, to the subsequent processing area. For example, in case of application of the present invention to the open-end spinning process, wherein a conveyer belt is utilized for carrying the yarn packages doffed from the open-end spinning machines and the yarn packages are transferred from the conveyer belt to a transportation carrier, the transportation carrier means is provided with a plurality of receiving rods. Each receiving rod is so designed that a free end thereof is capable of facing an end of the carrying passage of the yarn packages on the conveyer belt. When it is necessary to transfer the yarn packages to the transportation carrier from the conveyer belt, the transportation carrier is first positioned so as to place the free end of a receiving rod in the above-mentioned facing condition. Consequently, when the conveyer belt is driven so as to carry the yarn packages, the cylindrical tubes of the yarn packages carried to the terminal of their carrying passage on the conveyer belt are penetrated by the receiving rod which is positioned at the above-mentioned facing position. When a yarn package, or a plurality of yarn packages have been transferred onto the receiving rod of the carrier, the position of the carrier is adjusted so as to position the free end of another receiving rod in facing condition to the carrying passage of the yarn packages on the conveyer belt, and the above-mentioned transfer operation is again carried out.

Instead of the above-mentioned transportation carrier means, a conveyer composed of a plurality of carrying members provided with a receiving rod for receiving a single yarn package can be utilized in a manner similar to the above-mentioned receiving rod of the transportation carrier means.

BRIEF EXPLANATION OF THE DRAWINGS

FIG. 1 is a schematic plan view of an open-end spinning frame provided with a transportation apparatus according to the present invention;

FIG. 2 is a schematic side view of a part of the transportation apparatus shown in FIG. 1;

FIG. 3A is a schematic side view of another embodiment of the transferring device of the transportation apparatus according to the present invention;

FIG. 4 is a schematic side view of a transportation carrier equipped with a transferring device according to the present invention;

DETAILED ILLUSTRATION OF THE INVENTION

Figure 3B:
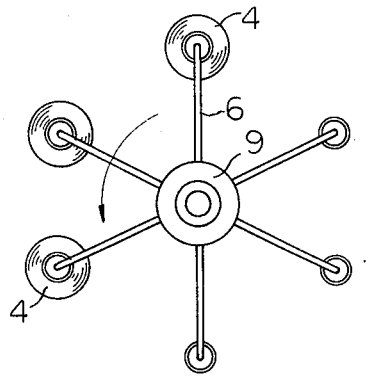
FIG. 3B is a schematic side view of the transferring device shown in FIG. 3A.

Referring to FIGS. 1 and 2, in an open-end spinning frame 1 provided with a plurality of spinning units 2 aligned in a row at each longitudinal side of the spinning frame 1, an endless conveyer belt 3 is disposed above a main frame (not shown) of the spinning frame 1 in the intervening space between the two rows of spinning units 2. The conveyer belt 3 is positively driven by a driving roller 3*a* at one end of the spinning frame 1, while a guide roller 3*b* for the conveyer belt 3 is disposed at the other end portion of the spinning frame 1. In this transportation apparatus, yarn packages 4 carried to a terminal position of the endless conveyer 3 are received on a plurality of receiving rods 6 which are horizontally and successively mounted on a transportation carrier 7. As shown in FIG. 1, each receiving rod 6 is positioned in such a way that a position of a free end of the rod 6 coincides with a terminal portion of the carrying passage of the yarn packages 4 formed on the respective cylindrical bobbins 5. Consequently, when the yarn packages 4 are displaced toward the terminal of the carrying passage of the yarn packages 4, the cylindrical bobbin 5 of each yarn package 4 is received by the receiving rod 6 and the previous yarn packages 4 received by the rod 6 are displaced toward the member 7 by the pushing action of a yarn package 4 which is forced onto the receiving rod 6.

Figure 3C:
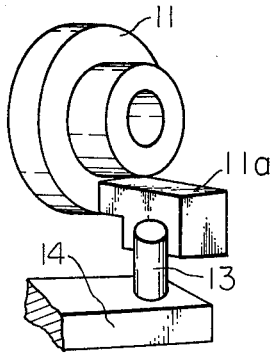
FIG. 3C is a perspective view of a stop means of the transferring device shown in FIG. 3A.

In the embodiment shown in FIGS. 3A, 3B and 3C the transportation device is provided with a horizontal shaft 8 which is rigidly mounted on a frame of the spinning apparatus 1. A supporting disk 9 is turnably mounted on the horizontal shaft 8 and six receiving rods 6 are radially mounted on the supporting disk 9 as shown in FIG. 3B. Each receiving rod 6 is provided with a bent free end portion 6*a*. A stop member 10 is secured to the bent free end portion 6*a*. A sliding member 11 is slidably mounted on an outside free end portion of the portion 6*a*. An expansion helical spring 12 is interposed between the stop member 10 and the sliding member 11. The sliding member 11 is provided with a horizontal projection 11*a* which is capable of contacting a stopper 13 mounted on a bracket 14 secured to a machine frame of the open-end spinning frame 1, when the receiving rod 6 arrives at a vertical position where the free end portion 6*a* of the receiving rod 6 is positioned on a carrying passage of the yarn package 4. At this position, the yarn package 4 is received on the free end portion 6*a* of the receiving rod 6 and then the sliding member 11 is displaced toward the stop member 10 by the moving inertia of the yarn package 4. Consequently, the above-mentioned engagement of the horizontal projection 11*a* with the stopper 13 is released so that the supporting disk 9 is turned counter-clockwise (in FIG. 3B) until the next receiving rod 6 arrives at the above-mentioned vertical disposition where the horizontal projection 11*a* of the sliding member 11 slidably mounted on the free end portion 6*a* of this receiving rod 6 comes into engagement with the stopper 13 (this position is hereinafter referred to as a receiving position). When the yarn package 4 held by a free end portion 6*a* of the receiving rod 6 is carried to the lowermost position where the receiving rod 6 is positioned at an opposite vertical position to the above-mentioned receiving position, the yarn package 4 slides downward along the receiving rod 6 and the package 4 is dropped on a transportation carrier 15, as shown in FIG. 3A. Therefore, if the transportation carrier 15 is properly positioned below the horizontal shaft 8, the yarn packages 4 can be transferred from the conveyer belt 3 to the carrier 15 automatically.

In the embodiment shown in FIG. 4, as a transportation device, a transportation carrier 15 provided with a plurality of upright receiving rods 106 is utilized. In this embodiment, for the sake of operational convenience, a curved hollow tube 18 is utilized. That is, the bottom portion of the hollow tube 18 fits into engagement with a top free end portion of the receiving rod 106, while the top portion of the tube 18 is curved toward the conveyer belt 3 in such a condition that the top end portion of the hollow tube 18 is capable of being positioned at a position which coincides with the carrying passage of the yarn package 4 formed on a cylindrical bobbin 5. Consequently, if the transportation carrier 15 is positioned properly, the yarn packages 4 are transferred to the receiving rods 106 of the carrier 15 successively through the hollow tube 18, and when a predetermined number of the yarn packages 4 are mounted on a receiving rod 106, the transportation carrier 15 is displaced so as to properly locate an empty receiving rod 106 at its receiving position. Finally, after all the receiving rods 106 of the transportation carrier 15 are fully occupied by the yarn packages 4, the yarn packages 4 are transported to the subsequent processing area.

Figure 5:
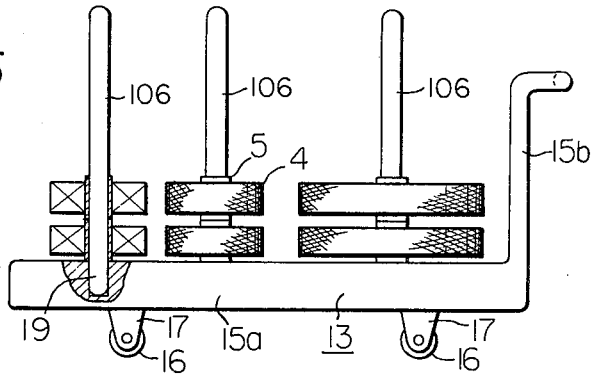
FIG. 5 is a detailed side view of a modified transportation carrier according to the present invention.
Figure 6:
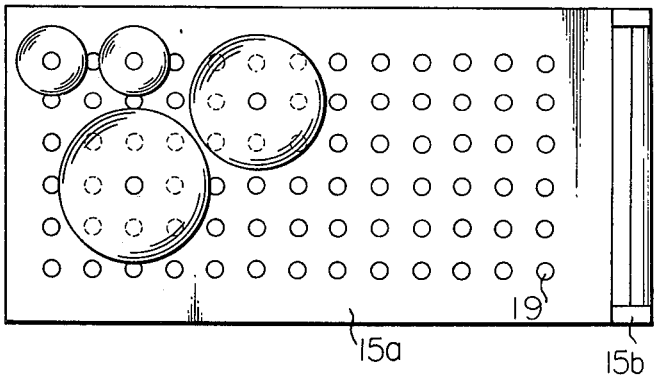
FIG. 6 is an elevational view of the transportation carrier shown in FIG. 5.
Figure 7:
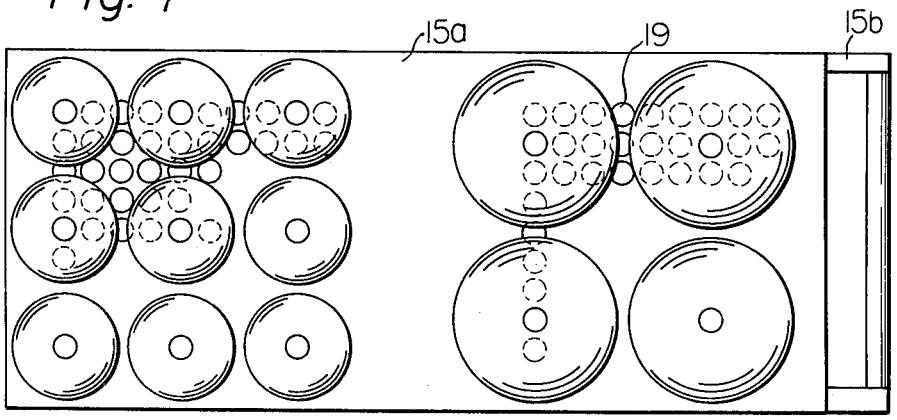
FIG. 7 is an elevational view of the transportation carrier shown in FIG. 5.
Figure 8A:
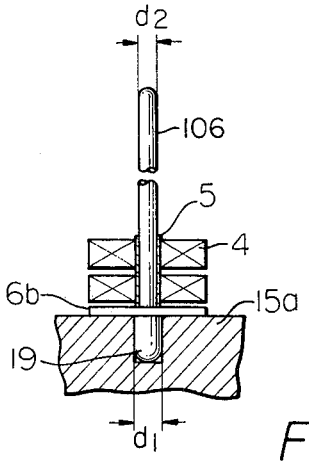
FIGS. 8A and 8B are sectional side views of receiving rods utilized for the transportation carrier shown in FIG. 7.
Figure 8B:
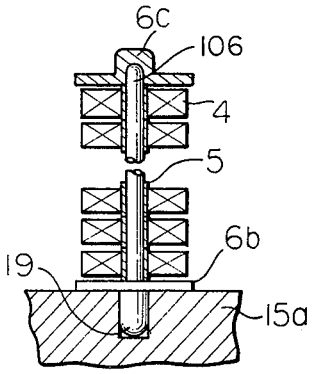

In the above-mentioned embodiment, the receiving rods 106 are rigidly mounted on a frame of the transportation carrier 15 and, consequently, this carrier 15 cannot be used for another purpose. Moreover, it is necessary to manually grip the yarn packages 4 when removing them from the receiving rods 106 when the yarn packages 4 are supplied to the subsequent processing area and, therefore, there is a certain possibility of damaging the yarn layers of the package 4. To eliminate the above-mentioned disadvantages, in the modified embodiment of the transportation carrier 15 shown in FIGS. 5 and 6, the transportation carrier 15 comprises a horizontal base 15*a* and front and back wheels 16, rotatably held by front and back supporting brackets 17 secured to the horizontal base 15*a* and a handle 15*b*. The horizontal base 15*a* is provided with a plurality of recesses 19 formed thereon so that the receiving rods 106 are capable of being inserted into the recesses 19. Consequently, if the receiving rods 106 are respectively inserted into some of the recesses 19 formed in the base plate 15*a* of the carrier 15, the carrier 15 can be used as a transportation carrier, while if the receiving rods 106 are separated from the base plate 15*a*, the carrier 15 can be used for another purpose. Further, by inserting the receiving rods 106 into apertures as shown in FIGS. 6 and 7, several yarn packages 4 having different diameters can be mounted on the receiving rods 106 without unused space remaining on the base plate 15*a*. In the above-mentioned embodiment, if the receiving rod 106 is provided with a stationary flange 6*b* as shown in FIGS. 8A, 8B, it is very easy to carry the yarn packages 4 without gripping the packages simply by handling the receiving rods 106 only. In this case, it is preferable to use a cap 6*c* which is capable of being mounted on the top of receiving rod 106. Further, if the diameter ($d_1$) of the recess 19 is larger than the lateral diameter ($d_2$) of the upper portion of the receiving rod 106, which is above the stationary flange 6*b*, and the diameter of the lower portion of the receiving rod 106 below the stationary flange 6*b* is identical to the diameter of the recess 19 so that they fit each other, and if several receiving rods 106 having different diameters $d_2$ are prepared, the utilization value of the transportation carrier 15 is increased in that it is able to receive yarn packages wound on cylindrical bobbins 5 having different diameters.

In the embodiment shown in FIG. 1, the waiting position of the receiving rod 6 of the transportation carrier 7 is maintained at a predetermined position which is suitable to receive the yarn packages 4. However, in spinning operations, it is impossible to produce yarn packages having an equal size, because it is impossible to prevent yarn breakages during the spinning operation. Consequently, the first embodiment shown in FIG. 1 is not practical in actual mill operations, because if the position of the receiving rod 6 is fixed so as to receive yarn packages, of full size, any yarn packages having a smaller size than the full package cannot be received by the receiving rod 6 of the transportation carrier 7. To eliminate the above-mentioned problem of the first embodiment, in a modified device according to the present invention shown in FIGS. 9, 10, 11 and 13, an auxiliary transfer means is utilized. That is, the auxiliary transfer means comprises an endless belt 20 which is turnably supported by a driving roller 21 and a guide roller 22 and a pair of supporting brackets 25 which supports the driving roller 21 and the guide roller 22 in rotatable condition. The brackets 25 are turnably mounted on a pair of vertical brackets 23 secured to a part of the machine frame by way of a horizontal shaft 24.

Figure 13:
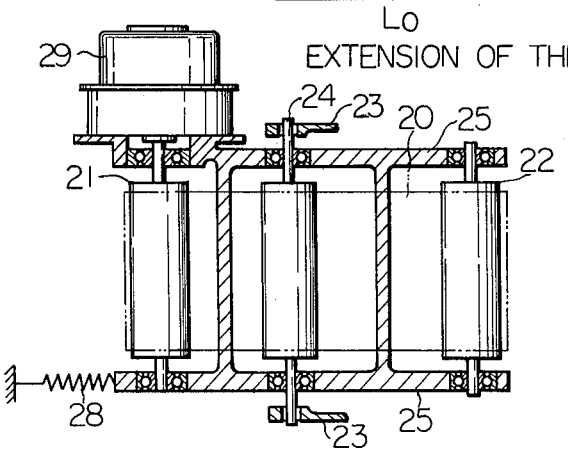
FIG. 13 is a schematic elevation of a part of the transportation apparatus shown in FIG. 11.

A tension spring 28 connects an end of the bracket 25 with the machine frame so as to urge the brackets 25 to turn in a counterclockwise direction (in FIG. 10) about the shaft 24. However, the above-mentioned counterclockwise turning motion of the brackets 25 is restricted by a stopper 26 which is secured to the machine frame. At a tip portion of the stopper, there is provided a limit switch 27 which detects the pushing of the bracket 25 against the limit switch 27 according to the counterclockwise turning motion of the brackets 25 (in FIG. 10). The positions of the limit switch 27 and the shaft 24 are so selected that when the bracket 25 contacts the limit switch 27, the brackets 25 are positioned horizontally. In this horizontal condition of the brackets 25, the upper surface of the conveyor belt 3 is aligned with with the upper surface of the endless belt 20. A motor 29 is mounted on the bracket 25 as shown in FIG. 13 so as to drive the driving roller 21.

Figure 12:
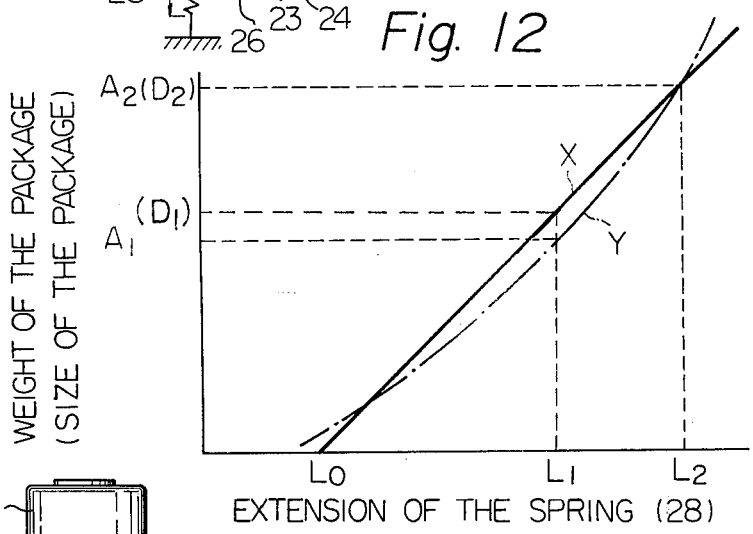
FIG. 12 is an explanation diagram showing the relationship between the extension of the spring utilized for the transferring device shown in FIG. 10 and the weight (size) of a yarn package.

When a yarn package 4 is carried to the terminal of the conveyer belt 3, the yarn package 4 is transferred to the endless belt 20 from the conveyer belt 3. As the endless belt 20 is driven by the driving roller 21, the yarn package 4 is carried toward the receiving rod 6. When the package 4 is carried over the horizontal shaft 24, the brackets 25 are turned clockwise (in FIGS. 10 and 11) about the shaft 24 according to the weight of the yarn package 4. This turning motion of the brackets 25 is created against the counter action of the spring 28. Consequently, the position of the brackets 25 in the balanced condition between the weight of the yarn package 4 and the spring 28 when the yarn package 4 is carried to the terminal position of the endless belt 20 varies according to the weight of the yarn package 4. According to our experimental tests, the relation between the weight of the yarn package 4 and the extension of the spring 28 can be represented by a linear line X shown in FIG. 12, while the relation between the diameter of the yarn package 4 and the size (diameter) of the yarn package 4 can be represented by a curved line which is quite similar to a linear line. Consequently, the relation between the package size (diameter) and the extension of the spring (28) can be approximately represented by a linear line, in other words, the extension of the spring 28 can be controlled in linear relationship with the variation of the package size. If the position of the receiving rod 6 of the transportation carrier 7 is so selected that the tip of the receiving rod 6 faces the cylindrical bobbin 5 whereon the yarn package 4 is formed, all of the yarn packages 4 can be received by the receiving rod 6. To clarify the above-mentioned positioning function of the transfer means, in the drawings of FIGS. 10, 11 and 12, providing that the extension of the spring 28 when a yarn package 4 having full size ($D_2$) is displaced to the transportation terminal of the endless belt 20 is represented by ($L_2$), and the weight of this yarn package 4 is represented by ($A_2$), while the extension of the spring 28 when a yarn package 4 having a smaller size ($D_1$) than the full package is displaced to the transportation terminal of the endless belt 20 is represented by ($L_1$) and the weight of this yarn package 4 is represented by ($A_1$), the initial length of the spring 28 is represented by ($L_o$); the actual curve Y representing the relation between the extension of the spring 28 and the package size can be made similar to the linear curve X, if a suitable spring is utilized.

With a practical transfer means, it is essential to prevent simultaneous double feed of the yarn packages on the endless belt 20. Consequently, the driving of the conveyer belt 3 is carried out intermittently by utilizing a conventional step driving mechanism (not shown). To drive the step driving mechanism, the limit switch 27 is utilized for this embodiment. That is, when the yarn package 4 on the endless belt 20 is transferred to the receiving rod 6, the bracket 25 is turned counterclockwise in FIG. 10 by the action of the spring 28, and the bracket 25 contacts the limit switch 27. Then the limit switch 27 actuates the step driving mechanism so as to transfer a yarn package 4 to the endless belt 20.

Figure 14:
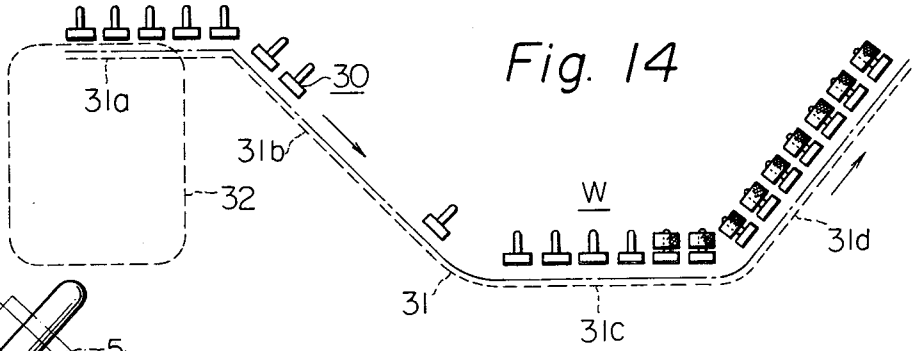
FIG. 14 is a schematic side view of a transportation conveyer according to the present invention.
Figure 15:
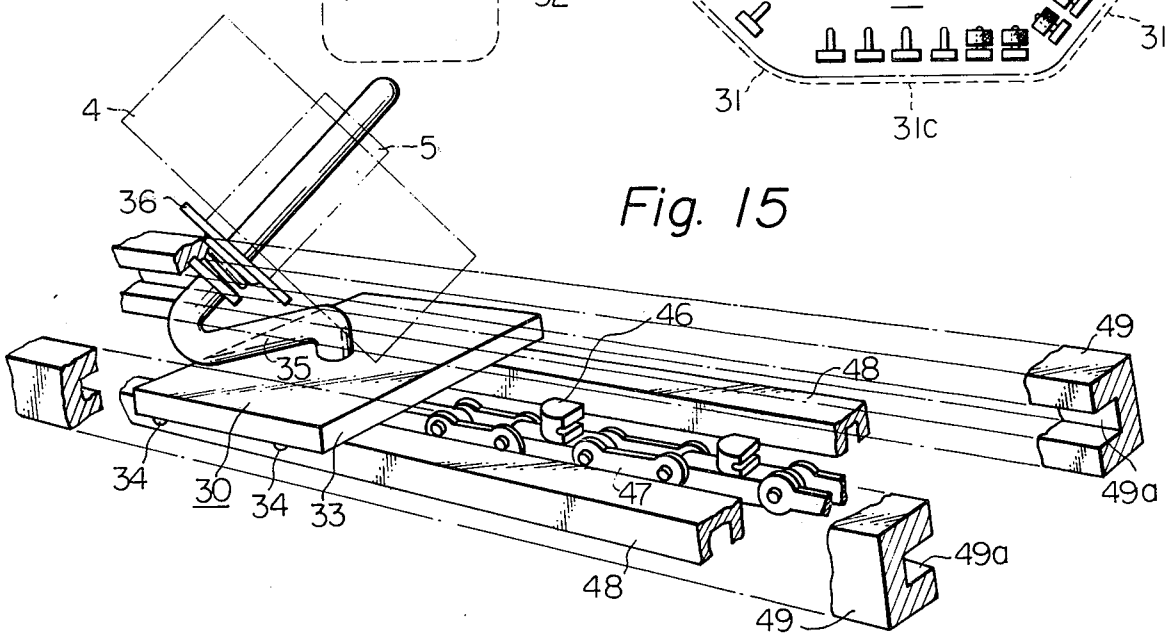
FIG. 15 is a perspective view of a part of the transportation conveyer shown in FIG. 14.
Figure 16:
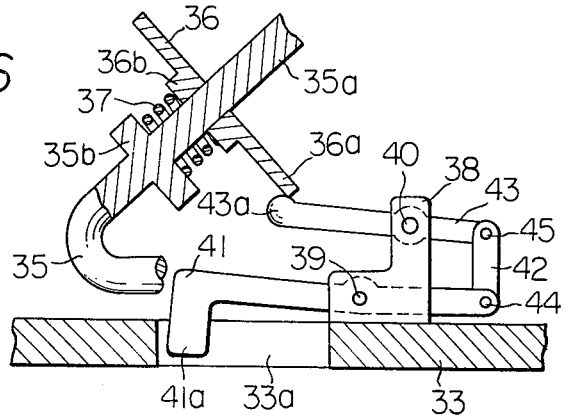
FIG. 16 is a schematic side view, partly in section, of a unit member of the transportation conveyor shown in FIG. 14.
Figure 17:
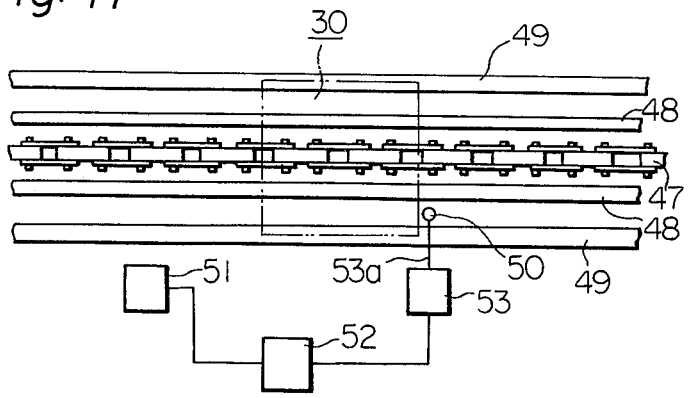
FIG. 17 is a schematic elevation of a package transfer station of the transportation conveyer shown in FIG. 14.
Figure 18:
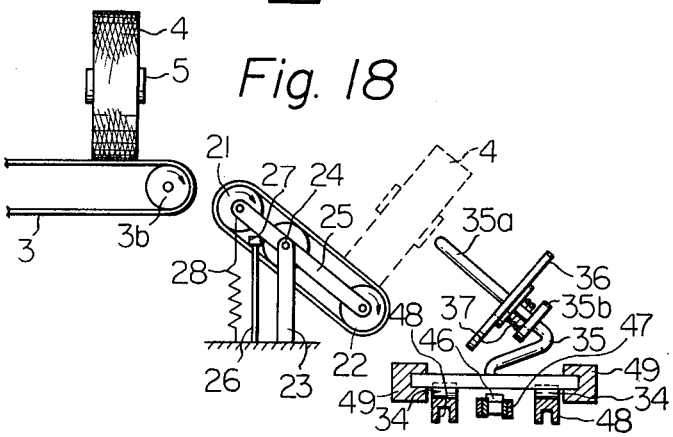
FIG. 18 is a schematic side view of a unit member of the transportation conveyer, at the package transfer station shown in FIG. 14.

In FIGS. 14, 15, 16, 17 and 18, another embodiment of the transportation apparatus according to the present invention is shown. In this embodiment, every receiving rod is mounted on a carrier which is conveyed by an endless conveyer which runs through the yarn package making processing area and the successive processing area. Referring to FIG. 14, a plurality of carriers 30 are carried by an endless conveyer 31 which is arranged so as to pass a transfer station W where the full packaged yarn packages 4 are transferred from the conveyer belt 3 to the carrier 30. Except at a portion facing the transfer station W, the endless conveyer 31 passes above the spinning machinery 1. Each carrier 30 from which a yarn package has been removed in the preceding process (hereinafter referred to as an empty carrier) is displaced to a passage 31*a* of the conveyer 31 by means of another endless chain conveyer 32. When the empty carriers 30 are moved to an inclined passage 31*b* of the conveyer 31, which is inclined from the overhead portion 31*a* to a transferring passage 31*c* facing the transfer station W, the carriers 30 can slide downward along a pair of guide rails of the conveyer 31, and when the carriers 30 are displaced to the passage 31c of the conveyer 31, each preceding carrier 30 is pushed forward by a subsequent carrier 30. When a yarn package 4 is transferred from the conveyer belt 3 to the receiving rod of the carrier 30, an engaging element (not shown) engages a hook member of the conveyer 31 so that the carrier 30 holding a yarn package 4 is positively displaced along an inclined passage 31d so that the carrier 30 is displaced toward the overhead passage of the conveyer 31 and transported to a successive processing area. Referring to FIGS. 15 and 16, the carrier 30 comprises a carrier plate 33 provided with a pair of rollers 34 turnably held on the underside thereof, a bent receiving rod 35 provided with a straight inclined portion 35a and a laterally expanded portion 35b formed near the bottom of the straight inclined portion 35a, a flange 36 slidably mounted on the straight inclined portion 35a and a compression spring 37 disposed between the expanded portion 35b and the flange 36 so as to always urge the flange 36 upward. The carrier plate 33 is provided with a cut out portion 33a and a bracket 38 is rigidly mounted on the carrier plate 33 as shown in FIG. 16, A hook lever 41 is turnably mounted on a pivot shaft 39 secured to the bracket 38 and another lever 43 is turnably mounted on a pivot shaft 40 also secured to the bracket 38. The levers 41 and 43 are connected by a link 42 by way of pins 44 and 45. The hook lever 41 is provided with a hook 41a at the free end portion thereof in such a way that the hook 41a is capable of projecting downward beyond the lower surface of the carrier plate 33 when the lever 41 turns counterclockwise about the pivot shaft 39 (in FIG. 16), and the lever 43 is provided with an expanded portion 43a formed at the free end thereof in such a condition that when the flange 36 is displaced downward, an edge portion 36a of the flange 36 pushes the expanded portion 43a of the lever 43, so that the hook lever 41 is turned counterclockwise (in FIG. 16) about the pivot shaft 39. The conveyer 31 comprises an endless chain 47 provided with a plurality of hook members 46 and a pair of first guide rails 48 disposed at both sides of the endless chain 47 so as to guide the rollers 34 of the carrier plate 33 and a pair of second guide rails 49 disposed above the first guide rails 48 so as to guide the carrier plate 33 by the guide grooves 49a being in a slidably engaging condition with the both edges of the carrier plate 33. When a yarn package 4 is mounted on the receiving rod 35, the flange 36 pushes the expanded portion 43a of the lever 43 so that the hook 41a of the hook lever 41 is projected through the cut out portion 33a of the carrier plate 33 downward. Consequently, the hook member 46 of the endless chain 47 engages the hook 41a, so that the carrier 30 is positively displaced by the motion of the endless chain 47. To attain a perfect transfer motion of the yarn package 4 from the conveyer 3 to the carrier 30, it is necessary to stop the carrier 30 at its exact working position. To attain this purpose, a non-contact limit switch 51 is disposed at a position a little upstream from the exact transfer position along the transfer passage 31c of the conveyer 31. A solenoid 53 is disposed at the exact transfer position along the transfer passage 31c and a stopper 50 is connected to a solenoid rod 53a in such a way that when the solenoid 53 is actuated, the solenoid rod 53a is projected toward the passage of the carrier plate 33 so that the stopper 50 disturbs further forward displacement of the carrier plate 33. To control the working time of the solenoid 53, a conventional timer relay 52 is utilized so as to electrically connect the limit switch 51 with the solenoid 53 as shown in FIG. 17. The transfer motion of the yarn package 4 from the conveyer 3 to the carrier 30 is carried out in a manner similar to the embodiment shown in FIGS. 9, 10 and 11 and, consequently, a detailed explanation thereof is omitted here.

Figure 19:
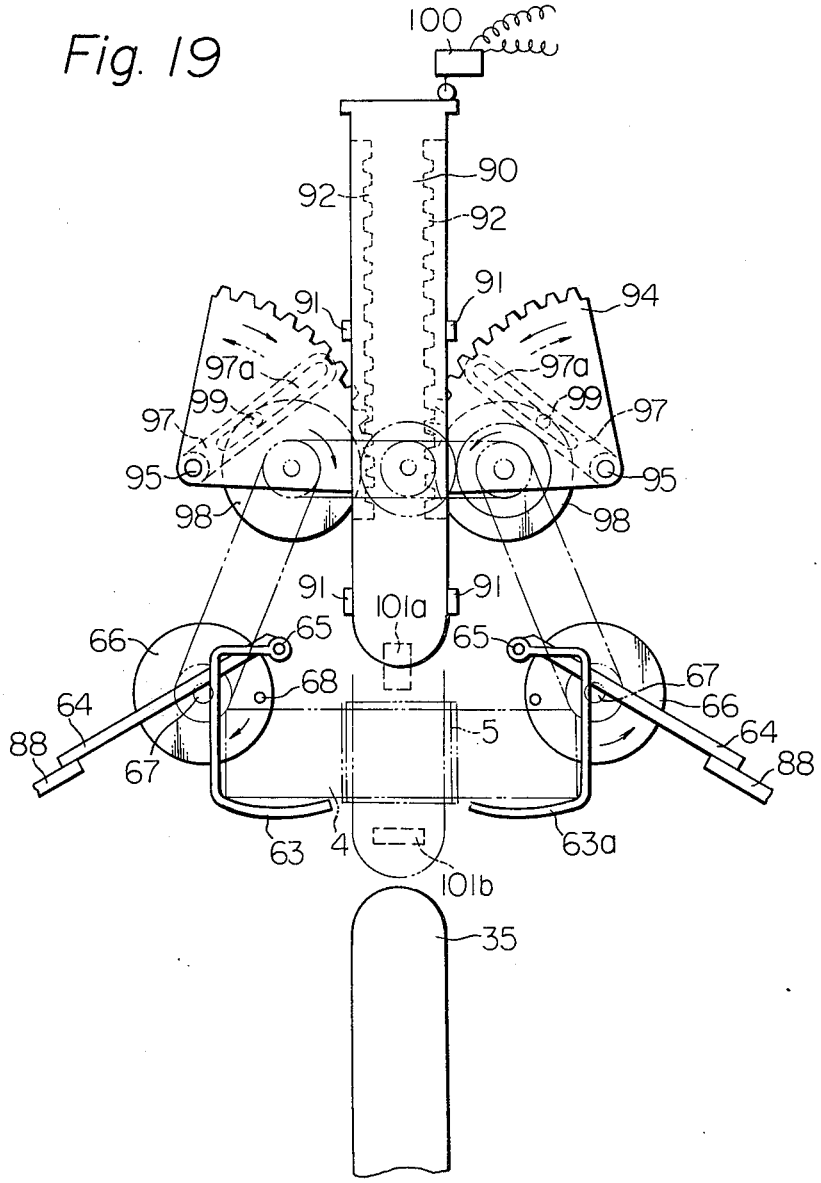
FIG. 19 is a side view of a positioning and transferring means utilized for the transportation devices according to the present invention.
Figure 20:
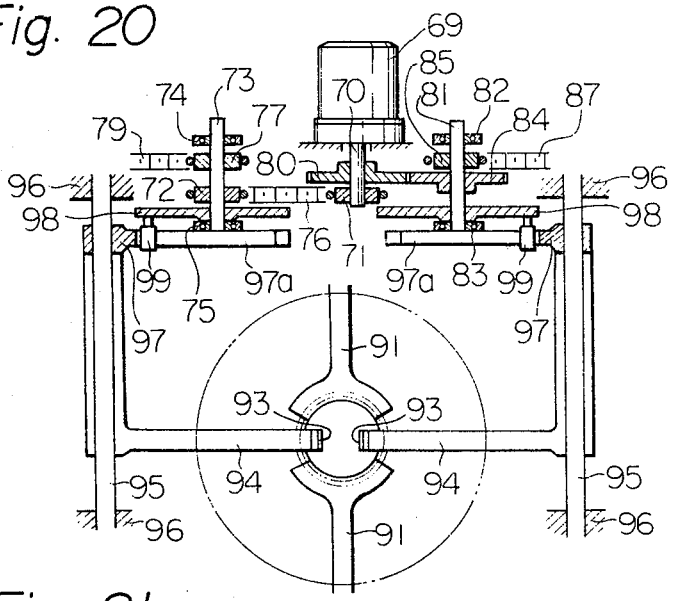
FIG. 20 is a plan view of a mechanism for actuating the positioning and transferring means shown in FIG. 19.
Figure 21:
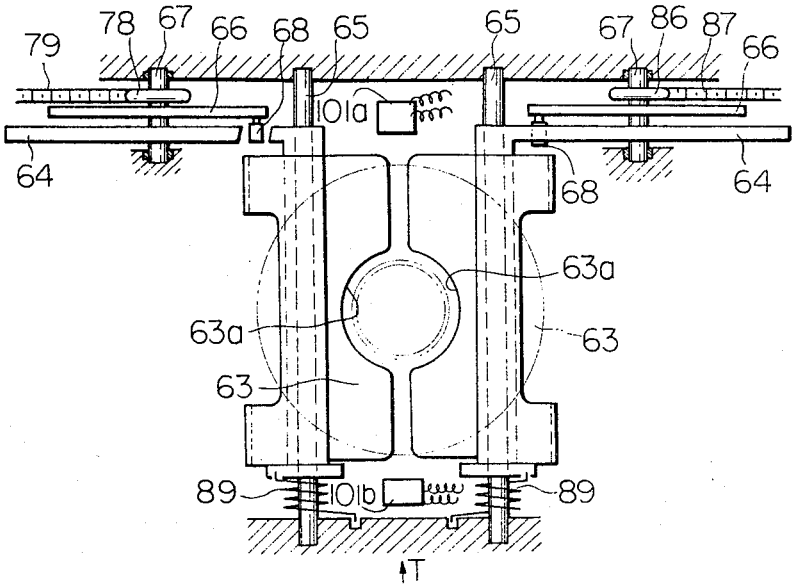
FIG. 21 is a side view of the mechanism shown in FIG. 20.

Another embodiment of the transfer device utilized for the transportation apparatus according to the present invention is shown in FIGS. 19 and 20. The transfer device is provided with a pair of holding plates 63 by which a yarn package 4 is held at a predetermined position. Each holding plate 63 is provided with a semi circular cut out portion 63a and a lever 64 off-set from the main portion thereof. Each lever 64 is turnably mounted on a corresponding supporting shaft 65. A pair of disks 66 are rigidly mounted on corresponding rotatable shafts 67, and each disk 66 is provided with a roller 68 rotatably mounted thereon at an edge portion thereof. A driving motor 69 is mounted on the frame of the device and one of the shafts 67 (left side in FIG. 21) is driven by a driving mechanism comprising a sprocket wheel 71 rigidly mounted on a motor shaft 70, a sprocket wheel 72 rigidly mounted on a shaft 73 rotatably supported by a pair of bearings 74, 75 rigidly mounted on the frame of the device, an endless chain 76 which transmits the rotation of the sprocket wheel 71 to the sprocket wheel 72, a sprocket wheel 77 rigidly mounted on the shaft 73, a sprocket wheel 78 rigidly mounted on the shaft 67 and an endless chain 79 which transmits the rotation of the sprocket wheel 77 to the sprocket wheel 78. The other shaft 67 (right side in FIG. 21) is driven by a driving mechanism comprising a gear 80 secured on the motor shaft 70, a shaft 81 rotatably supported by a pair of bearings 82, 83 mounted on the frame (not shown) of the device, a gear 84 rigidly mounted on the shaft 81 in such a way that the gear 84 meshes with the gear 80, a sprocket wheel 85 rigidly mounted on the shaft 81, a sprocket wheel 86 rigidly mounted on the shaft 67 and an endless chain 87 which transmits the rotation of the sprocket wheel 85 to the sprocket wheel 86. Each lever 64 is always urged toward a corresponding stationary piece 88 mounted on the frame (not shown) of the device by a corresponding spring 89. A guide rod 90 is slidably supported by pairs of guide members 91 and is provided with a pair of racks 92 formed in the respective longitudinal grooves 93 which is formed along the longitudinal axis of the guide rod 90 in symmetrical condition. The guide members 91 are rigidly mounted on the frame (not shown) of the device. A pair of sector gears 94 are rotatably mounted on a corresponding shaft 95, and each shaft 95 is rigidly supported by a pair of brackets 96 secured to the frame (not shown) of the device. Each sector gear 94 is provided with a swing lever 97 off-set from an end portion thereof. Each swing lever 97 is provided with a groove 97a. A pair of disks 98 are rigidly mounted on the respective shafts 73 and 81 so that these disks 98 are driven by the driving motor 69 by way of the driving mechanisms which are hereinbefore described. Each disk 98 is provided with a roller 99 rotatably mounted on an edge portion thereof in an engaging condition into the respective grooves 97a of the swing levers 97. Consequently, according to the rotation of the disks 98, the sector gears 94 are driven by way of the respective swing levers 97, the guide rod 90 is displaced upward or downward along a passage defined by the guide members 91. A limit switch 100 is mounted on a bracket (not shown) secured to the frame (not shown) of the device at a position corresponding to the uppermost position of the top of the guide rod 90 so as to detect the arriving of the guide rod 90. As the guide rod 90 is inserted into the hollow cylindrical bobbin 5 of a yarn package 4, the diameter thereof must be a little smaller than the diameter of the inside cylindrical wall of the bobbin 5. In the above-mentioned embodiment, a portion of the holding plates 63 which supports the yarn package 4 is designed so as to have a curved surface which coincides with a part of the cylindrical surface having a central axis which is common to the respective shafts 65. Consequently, the yarn package 4 can be held at a constant level by the holding plates 63 in a free condition from the turning motion of the holding plates 63.

Figure 9:
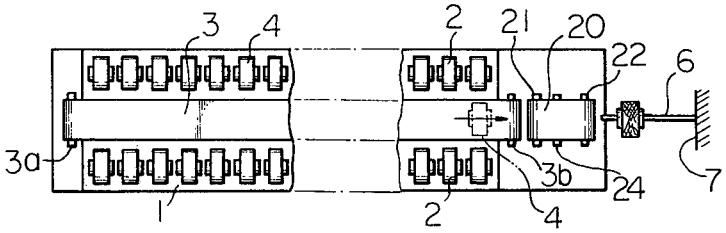
FIG. 9 is a schematic plan view of an open-end spinning frame provided with a modified transportation apparatus according to the present invention.
Figure 10:
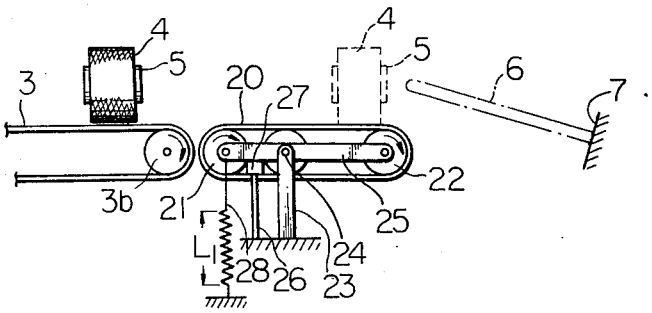
FIGS. 10 and 11 are schematic side views of a part of the transportation apparatus shown in FIG. 9, showing the working function thereof.
Figure 11:
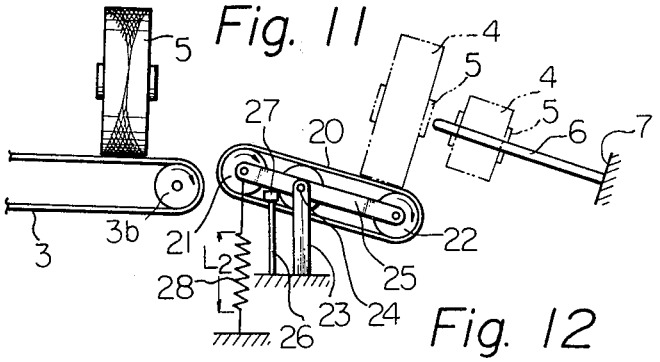

In the above-mentioned embodiment, the transfer motion of the yarn package 4 from the conveyer belt 3 (see FIG. 9) to the transfer device mentioned above is carried out in a manner similar to the embodiment shown in FIG. 9. That is, in this embodiment, the holding plates 63, which are positioned at their receiving positions which correspond to the waiting position of the endless belt 22 shown in FIG. 9, receive the yarn package 4 from the conveyer belt 3 in a manner similar to the embodiment shown in FIG. 9. To confirm that a yarn package 4 has been transferred from the conveyer belt 3 to the holding plates 63, a photoelectric detector, comprising a light projector 101*a* and a photocell 101*b*, is disposed at such positions that the light emitted from the light projector 101*a* passes along an inclined light passage which passes a receiving position of a yarn package 4 by the holding plates 63 and is received by the photocell 101*b* if there is not any yarn package 4 on the holding plates 63. As the yarn packages 4 are transferred from the conveyer belt 3 to the holding plates 63 from a direction represented by an arrow T in FIG. 21, the light projector 101 *a* is disposed at a higher level while the photocell 101*b* is disposed at a lower level so as to not disturb the transfer motion of the yarn package 4 from the conveyer belt 3 to the holding plates 63. To position a yarn package 4 at a correct receiving position on the holding plates 63, it is preferable that the opened space defined by the semi circular cut out portion of the holding plates 63 must have a little larger diameter than the peripheral diameter of the cylindrical tube of the yarn package 4 so that, when a yarn package 4 is held by the holding plates 63, the end portion of the bobbin can be engaged into the above-mentioned opened space. The above-mentioned photoelectric detector issues an electric signal to actuate the driving motor 69 when a yarn package 63 blocks the light beam issued from the light projector 101*a*. To utilize the above-mentioned transfer device, a transportation device such as shown in FIGS. 14 and 15 is preferably used. However, in this case, the receiving rod 35 of the carrier 30 must be shaped so that it is perpendicular to the carrier plate 33, instead of the curved rod 35 of the embodiment shown in FIGS. 14 and 15.

Figure 22A:
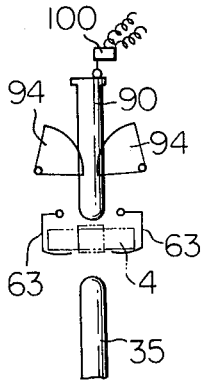
FIGS. 22A, 22B, 22C, 22D, 22E and 22F are explanatory drawings showing the working conditions of the positioning and transferring means shown in FIG. 19.
Figure 22B:
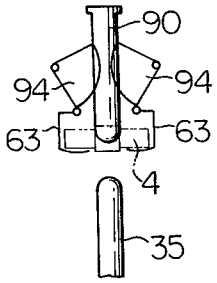
Figure 22C:
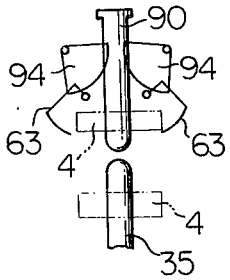
Figure 22D:
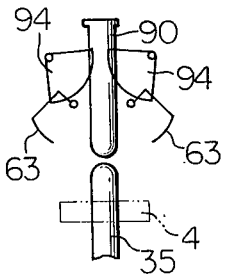
Figure 22E:
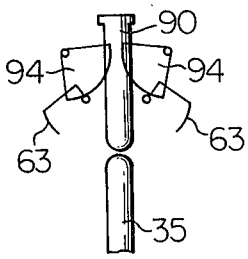
Figure 22F:
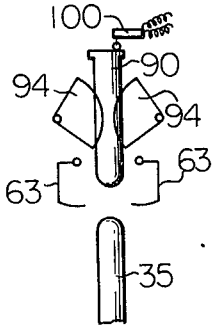
Figure 23:
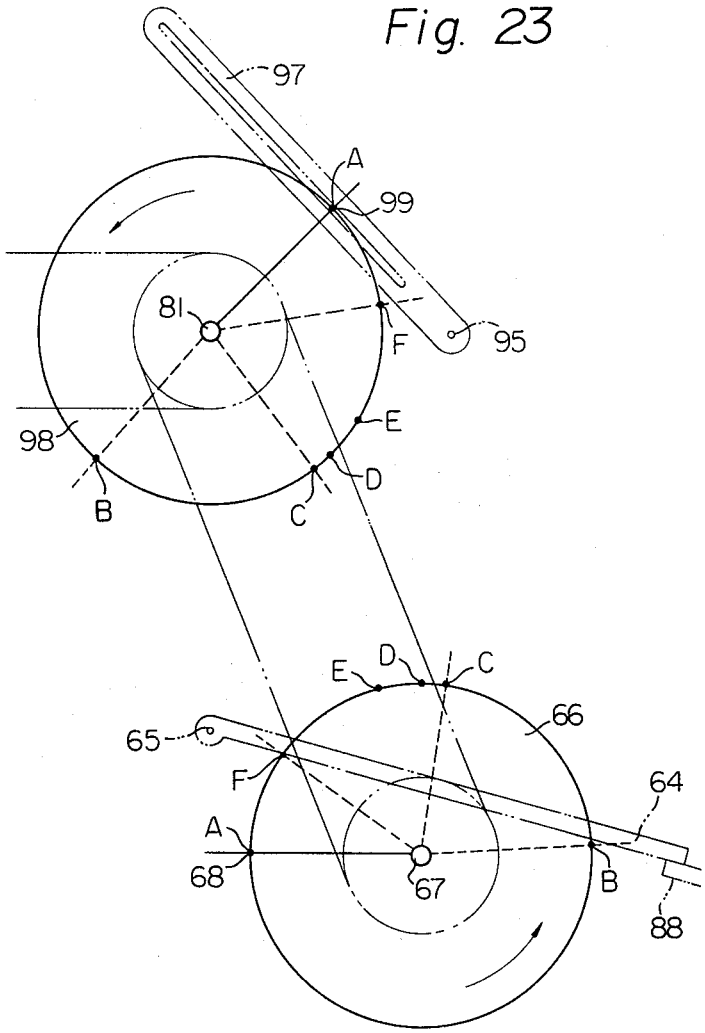
FIG. 23 is a schematic side view of a part of the positioning and transferring means shown in FIG. 19.

The motion of the above-mentioned transfer device is hereinafter illustrated in detail with reference to the schematic drawings shown in FIG. 22 in case of utilizing the above-mentioned transportation device. When the driving motor 69 is actuated, the disks 66 and 98 are turned so that the guide rod 90 is displaced downward, and the holding plates 63 are still maintained in the package receiving condition until a bottom end portion of the guide rod 90 is inserted into the cylindrical bobbin 5 of the yarn package 4. The above condition is shown in FIG. 22A and FIG. 22B. And when the insertion of the end portion of the guide rod 90 into the bobbin 5 is completed, the holding plates 63 commence their opening motion (FIG. 22C). To attain the above-mentioned working condition the engaging condition of the roller 68 with the lever 64 is predetermined. That is, when the rollers 68 engage the respective levers 64, the levers 64 are turned so that the holding plates 63 are turned outwards. The relative position of these elements is shown in FIG. 23 in detail. In FIG. 23, (A), (B), (C), (D), (E) and (F) represent conditions corresponding to the drawings of FIGS. 22A, 22B, 22C, 22D, 22E and 22F.

Consequently, when the holding plates 63 are turned toward the outsides, as the end of the guide rod 90 has been displaced to a position adjacently facing the top end of the receiving rod 35 of the carrier 30 (FIGS. 14, 15), the yarn package 4 is dropped from the guide rod 90 and mounted on the receiving rod 35 (FIG. 22C). Next, the guide rod 90 commences its displacement upward and the holding plates 63 are turned to their ultimate outside positions (FIGS. 22D and 22E). Then the holding plates 63 commence to turn toward their waiting closed positions and when each lever 64 contacts the stationary piece 20 according to the motion following to the motion of the roller 68, the holding plates 63 are returned to their waiting closed positions, and finally the guide rod 90 is also returned to its waiting position shown in FIG. 22A, and the limit switch 100 is actuated by the above-mentioned upward motion of the guide rod 90 so that the motion of the driving motor 69 is stopped. The above-mentioned one cycle motion of the guide rod 90 and the holding plates 63 are repeated each time a yarn package 4 is received by the holding plates 63. As described above, after a yarn package 4 is held at a correct position by the holding plates 63, the guide rod 90 is inserted into the cylindrical tube 5*a* of a yarn package 4 and then the yarn package 4 is transferred to the receiving rod 35 of a carrier 30 and the transfer of a yarn package 4 from the conveyer belt 3 (FIG. 9) to a carrier 30 (FIG. 14) can be carried out in a satisfactory manner.

What is claimed is:

1. Method for transporting yarn packages formed on cylindrical tubes in a plurality of spinning units in a textile machine to another processing area comprising, doffing yarn packages from said spinning units directly to a common conveyor belt disposed adjacent to said textile machine, with the axes of said tubes parallel to the transport direction of said belt, transferring said yarn packages from a terminal portion of said conveyor belt to a receiving rod by inserting said receiving rod into the cylindrical tube of each yarn package, and displacing said receiving rod to move the package to the other processing area.

2. The method of claim 1 further comprising returning said rod to relative alignment with respect to yarn packages on said conveyor belt for receiving a further yarn package, following said step of displacing said receiving rod.

3. The method of claim 2 wherein said step of returning said rod to relative alignment comprises moving said rod to extend substantially parallel to the direction of movement of said yarn packages.

4. The method of claim 1 further comprising relatively moving said rod with respect to said yarn packages on said conveyor, following said step of displacing, to align said rod coaxially with a further yarn package on said conveyor for receiving said further yarn package.

5. The method of claim 4 wherein said step of transferring comprises moving said yarn package in a direction parallel to the axis of said yarn package whereby the tubes of said yarn package are sequentially moved over said rod.

6. Method for transporting one or more yarn packages formed on a cylindrical tube by a textile machine to another processing area comprising a. conveying said yarn packages by a conveyer belt disposed at a position adjacent to said textile machine toward a terminal position of said conveyer belt, with said conveyor belt being aligned so that an axial direction of each of said yarn packages carried thereby coincides with a common carrying passage of said yarn packages along said conveyor belt to said terminal position, b. positioning a receiving rod at said terminal position of said conveyer belt aligned so that an axial direction of said receiving rod coincides with said common carrying passage, when said transporting operation is carried out, c. transferring each of said yarn packages from said conveyer belt to said receiving rod by inserting said receiving rod into said cylindrical tube of said yarn packages during the carrying motion of said yarn package along said terminal position of said conveyer belt, d. and displacing said receiving rod to move said yarn packages transferred thereto to the other processing area.

7. The method of claim 6 wherein said step of transferring comprises transferring the yarn packages to said receiving rod while maintaining said terminal position at a fixed position with respect to said textile machine.

8. The method of claim 7 further comprising moving said receiving rod with respect to said terminal position following said step of displacing, to reposition said receiving rod at said terminal position so that said axial direction of said receiving rod coincides again with said common carrying passage, for receiving further yarn packages from said conveyor belt.

* * * * *

UNITED STATES PATENT OFFICE

CERTIFICATE OF CORRECTION

Patent No. 3,946,884 Dated March 30, 1976

Inventor(s) Takashi Kato et al.

It is certified that error appears in the above-identified patent and that said Letters Patent are hereby corrected as shown below:

On the cover sheet item 30, lines 1, 2 and 3, should read

-- Jan. 23, 1973 Japan 48-96662

May 17, 1973 Japan 48-55027

June 26, 1973 Japan 48-72066 --.

Signed and Sealed this

Twenty-first Day of September 1976

[SEAL]

*Attest:*

RUTH C. MASON
*Attesting Officer*

C. MARSHALL DANN
*Commissioner of Patents and Trademarks*